US010054906B2

(12) United States Patent
Matsuno et al.

(10) Patent No.: US 10,054,906 B2
(45) Date of Patent: Aug. 21, 2018

(54) WEARABLE TERMINAL APPARATUS

(71) Applicant: SEIKO EPSON CORPORATION, Tokyo (JP)

(72) Inventors: Atsuhiko Matsuno, Azumino (JP); Yoshihiro Tatara, Shiojiri (JP); Yosuke Wakamiya, Matsumoto (JP); Tomohiro Ogawa, Shiojiri (JP); Akira Hatta, Kyoto (JP); Ryota Fujinaka, Kyoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/288,714

(22) Filed: Oct. 7, 2016

(65) Prior Publication Data

US 2017/0115632 A1 Apr. 27, 2017

(30) Foreign Application Priority Data

Oct. 22, 2015 (JP) ..... 2015-207728

(51) Int. Cl.

| | |
|---|---|
| ***G04B 19/04*** | (2006.01) |
| ***G04B 19/06*** | (2006.01) |
| ***G04B 47/06*** | (2006.01) |
| ***G04G 21/02*** | (2010.01) |

(52) U.S. Cl.

CPC ..... *G04B 19/048* (2013.01); *G04B 19/06* (2013.01); *G04B 47/06* (2013.01); *G04B 47/061* (2013.01); *G04B 47/063* (2013.01); *G04B 47/065* (2013.01); *G04B 47/066* (2013.01);

(Continued)

(58) Field of Classification Search

CPC ..... G04B 19/0087; G04B 19/048; G04B 19/087; G04B 47/06; G04B 47/061; G04B 47/063; G04B 47/065; G04B 47/066; G04B 47/068; G04G 21/02; G04G 21/025

See application file for complete search history.

(56) References Cited

U.S. PATENT DOCUMENTS 2,706,962 A * 4/1955 Kebbon ..... G01K 5/62 116/221
2,763,122 A * 9/1956 Hayes ..... G04B 47/068 368/11

(Continued)

FOREIGN PATENT DOCUMENTS

JP 2010-107333 A 5/2010

*Primary Examiner* — Amy Cohen Johnson
*Assistant Examiner* — Daniel Wicklund
(74) *Attorney, Agent, or Firm* — ALG Intellectual Property, LLC

(57) ABSTRACT

A wearable terminal apparatus includes an enclosure, a dial provided in the enclosure and having on-dial markings, a first timepiece hand, a second timepiece hand, a third timepiece hand, a processing section that controls rotation of the first timepiece hand, the second timepiece hand, and the third timepiece hand, and a measured value acquisition section that acquires a measured value. The processing section controls placement of the timepiece hands among the on-dial markings in such a way that the first timepiece hand is placed in a position corresponding to a lower limit value of the measured value, the second timepiece hand is placed in a position corresponding to an upper limit value of the measured value, and the third timepiece hand is placed in a position corresponding to the measured value.

20 Claims, 16 Drawing Sheets

(52) U.S. Cl.
CPC ..... *G04B 47/068* (2013.01); *G04G 21/02* (2013.01); *G04G 21/025* (2013.01)

(56) References Cited

U.S. PATENT DOCUMENTS

| | | | | | |
|---|---|---|---|---|---|
| 3,016,038 | A * | 1/1962 | Stiens | G01D 13/24 | 116/293 |
| 3,041,997 | A * | 7/1962 | Hartwell | G01D 13/24 | 116/293 |
| 3,056,401 | A * | 10/1962 | Greenspan | A61B 5/021 | 128/900 |
| 3,377,860 | A * | 4/1968 | Masters | G04B 47/066 | 368/10 |
| 3,901,217 | A * | 8/1975 | Clark | A61B 5/022 | 116/271 |
| 5,086,416 | A * | 2/1992 | Dubois | G04B 19/266 | 368/18 |
| 5,724,317 | A * | 3/1998 | Kubota | G01D 13/24 | 368/10 |
| 6,234,106 | B1 * | 5/2001 | Dohnal | H01H 9/0033 | 116/284 |
| 7,343,873 | B2 * | 3/2008 | Hernandez, Jr. | H01H 9/0033 | 116/289 |
| 2004/0233788 | A1 * | 11/2004 | Plancon | G04B 19/082 | 368/11 |
| 2005/0237861 | A1 * | 10/2005 | Bell | G04B 19/04 | 368/223 |
| 2007/0016091 | A1 * | 1/2007 | Butt | G04G 21/025 | 600/519 |
| 2013/0051189 | A1 * | 2/2013 | Springer | G04C 17/0091 | 368/69 |
| 2013/0064045 | A1 * | 3/2013 | Essery | H04W 88/02 | 368/47 |
| 2016/0306442 | A1 * | 10/2016 | Lee | G06F 3/0362 | |
| 2016/0327915 | A1 * | 11/2016 | Katzer | G04B 19/04 | |
| 2016/0341568 | A1 * | 11/2016 | Roush | G01C 22/006 | |
| 2017/0075305 | A1 * | 3/2017 | Ryu | G04G 9/0064 | |

* cited by examiner

WEARABLE TERMINAL APPARATUS

CROSS-REFERENCES TO RELATED APPLICATIONS

This application claims priority to Japanese Patent Application No. 2015-207728, filed Oct. 22, 2015, the entirety of which is herein incorporated by reference.

BACKGROUND

1. Technical Field

The present invention relates to a wearable terminal apparatus and others.

2. Related Art

In recent years, a wearable terminal apparatus (electronic instrument), such as a wristwatch-shaped terminal apparatus, has been advancing in terms of functionality, and it is necessary to skillfully display information on a plurality of functions. As the wearable terminal apparatus that displays information on a plurality of functions, there is, for example, a known wristwatch-shaped terminal apparatus having a plurality of on-dial markings provided on a function basis. Further, as an analog timepiece that does not employ a liquid crystal display or any other similar display, in particular, there is a known timepiece that includes a plurality of small windows in a display surface to display a plurality of pieces of information at the same time, such as the invention disclosed in JP-A-2010-107333.

The wearable terminal apparatus having a plurality of on-dial markings provided on a display surface (dial) undesirably allows a user to readily read information. For example, when the plurality of on-dial markings are located below a hand, it is difficult to identify which on-dial marking the hand points at and determine a value corresponding to the on-dial marking.

Further, in recent years, many wearable terminal apparatus products incorporate a variety of sensors, and an approach of providing a small window on an information type basis, such as the approach in the invention disclosed in JP-A-2010-107333, hardly becomes a solution in some cases. An example of such cases is a wearable terminal apparatus that incorporates a large number of sensors and displays information from each of the sensors through the corresponding small window, and the size of each of the windows decreases because the number of small windows is too large. The approach of providing small windows further makes it difficult for the user to visually recognize the small on-dial markings through the small windows.

SUMMARY

An advantage of some aspects of the invention is to provide a wearable terminal apparatus and others capable of displaying a plurality of pieces of information in such a way that a user readily identifies the information with no increase in the number of on-dial markings or the number of indication hands.

An aspect of the invention relates to a wearable terminal apparatus including an enclosure, a dial provided in the enclosure and having on-dial markings, a first timepiece hand, a second timepiece hand, a third timepiece hand, a processing section that controls rotation of the first timepiece hand, the second timepiece hand, and the third timepiece hand, and a measured value acquisition section that acquires a measured value, wherein the processing section controls placement of the timepiece hands among the on-dial markings in such a way that the first timepiece hand is placed in a position corresponding to a lower limit value of the measured value, the second timepiece hand is placed in a position corresponding to an upper limit value of the measured value, and the third timepiece hand is placed in a position corresponding to the measured value.

In the aspect of the invention, placement of the timepiece hands among the on-dial markings is so controlled that the first timepiece hand is placed in a position corresponding to the lower limit value of a measured value, the second timepiece hand is placed in a position corresponding to the upper limit value of the measured value, and the third timepiece hand is placed in a position corresponding to the measured value. A plurality of pieces of information can therefore be displayed in such a way that a user can readily identify the information with no increase in the number of on-dial markings or the number of indication hands.

In the aspect of the invention, the first timepiece hand may be one of an hour hand and a minute hand, the second timepiece hand may be another hand different from the one hand, and the third timepiece hand may be a second hand.

A variety of measured values can be displayed or otherwise indicated by using the first timepiece hand, the second timepiece hand, and the third timepiece hand, which are timepiece hands for displaying time.

In the aspect of the invention, the measured value acquisition section may acquire at least one of living body detection information, activity detection information, and environment detection information as the measured value.

At least one of the living body detection information, activity detection information, and environment detection information can thus be displayed or otherwise indicated.

In the aspect of the invention, the processing section may switch a first display mode in which a first measured value is displayed and a second display mode in which a second measured value is displayed from one to another, and positions where the first timepiece hand and the second timepiece hand are placed among the on-dial markings in the first display mode may differ from positions where the first timepiece hand and the second timepiece hand are placed among the on-dial markings in the second display mode.

Measured values of at least two types of information can thus be displayed or otherwise indicated.

In the aspect of the invention, in the first display mode, the processing section may control the timepiece hands in such a way that the first timepiece hand is placed in a position corresponding to a lower limit value of a first measurement range corresponding to the first measured value and the second timepiece hand is placed in a position corresponding to an upper limit value of the first measurement range, and in the second display mode, the processing section may control the timepiece hands in such a way that the first timepiece hand is placed in a position corresponding to a lower limit value of a second measurement range corresponding to the second measured value and the second timepiece hand is placed in a position corresponding to an upper limit value of the second measurement range.

The first timepiece hand and the second timepiece hand can thus display or otherwise indicate a measurement range appropriate for each measured value.

In the aspect of the invention, the wearable terminal apparatus may further include a detection section that detects operation of rotating an operation member rotatable around a predetermined axis of rotation, and when the detection section detects the operation of rotating the operation member, the processing section may performed the switching of the first display mode and the second display mode from one to another.

The user can thus switch or otherwise change the display mode by performing simple operation of rotating a rotary bezel or a crown.

In the aspect of the invention, the first display mode and the second display mode may be two display modes out of an altitude display mode, an atmospheric pressure display mode, a pulse display mode, a step count display mode, and a distance display mode.

With this configuration, at least two measured values out of, for example, the altitude, atmospheric pressure, pulse rate, step count, and travel can be displayed or otherwise indicated.

In the aspect of the invention, the on-dial markings in a first range of the dial may differ from the on-dial markings in a second range of the dial in terms of a magnitude of a numeral represented by one marking.

With this configuration, even when a plurality of types of measured value are displayed by using common on-dial markings, each measured value and measurement range can be readily read or otherwise recognized.

In the aspect of the invention, the on-dial markings may be arranged on the dial in a circular or arcuate manner.

A measured value and a measurement range can thus be displayed or otherwise indicated without a large amount of change of the configuration of the hour hand, the minute hand, and the secondhand from the configuration of them of a typical timepiece.

In the aspect of the invention, the wearable terminal apparatus may further include a fourth timepiece hand and a second dial provided in correspondence with the fourth timepiece hand and having second on-dial markings, and the processing section may control placement of the fourth timepiece hand among the second on-dial markings on the second dial in such a way that the fourth timepiece hand is placed in a position corresponding to the measured value.

The user can therefore, for example, check time indicated by the first timepiece hand to the third timepiece hand and check the numeral of another measured value at the same time.

In the aspect of the invention, the wearable terminal apparatus may further include a fourth timepiece hand and an icon area provided in correspondence with the fourth timepiece hand and provided with a plurality of icons, and the processing section may control placement of the fourth timepiece hand in the icon area and in a position corresponding to an icon selected from the plurality of icons.

The user can therefore, for example, check time indicated by the first timepiece hand to the third timepiece hand and check another piece of information at the same time.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below. It is not intended that the present embodiment described below unduly limits the contents of the invention set forth in the appended claims. Further, all configurations described in the present embodiment are not necessarily essential configuration requirements of the invention.

1. Overview

A wearable terminal apparatus according to the present embodiment displays a plurality of pieces of information in such a way that a user readily identifies the information. The wearable terminal apparatus is, for example, a wristwatch-shaped terminal apparatus, such as that shown in FIG. 2, which will be described later.

Figure 4:
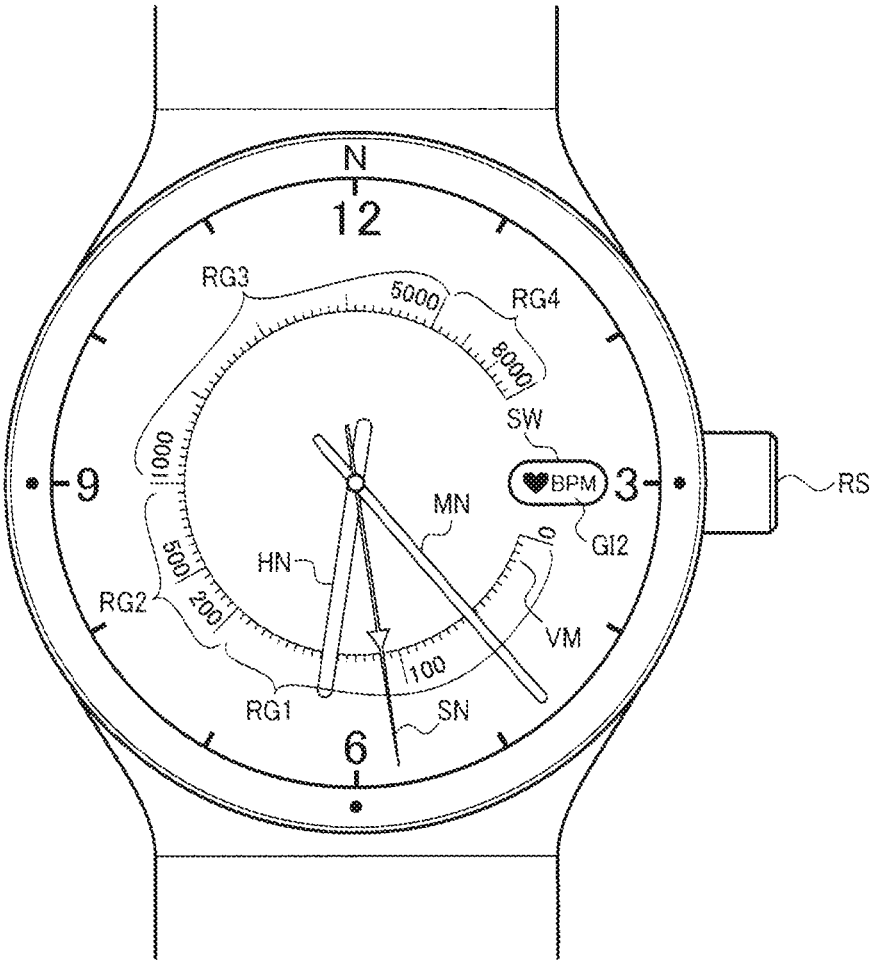
FIG. 4 describes a pulse display mode.

The wristwatch-shaped terminal apparatus according to the present embodiment includes, for example, an hour hand HN, a minute hand MN, a second hand SN, a dial having on-dial markings VM, and a crown RS, as shown in FIG. 4, which will be described later. A user (wearer) of the wristwatch-shaped terminal apparatus can operate the crown RS to set the apparatus in a mode in which information other than time is displayed. For example, in the example shown in FIG. 4, the wristwatch-shaped terminal apparatus is set in a mode in which the pulse rate is displayed. In this case, the hour hand HN points at an upper limit value of a measurement range of the pulse rate, the minute hand MN points at a lower limit value of the measurement range of the pulse rate, and the secondhand SN points at a measured value of the pulse rate. The user can visually recognize the hour hand HN and the minute hand MN pointing at two of the on-dial markings VM to read the measurement range and focus attention on the thus read measurement range out of the on-dial markings VM. The user can then visually recognize the second hand SN pointing at a value within the measurement range to read the measured value of the pulse rate.

Figure 6:
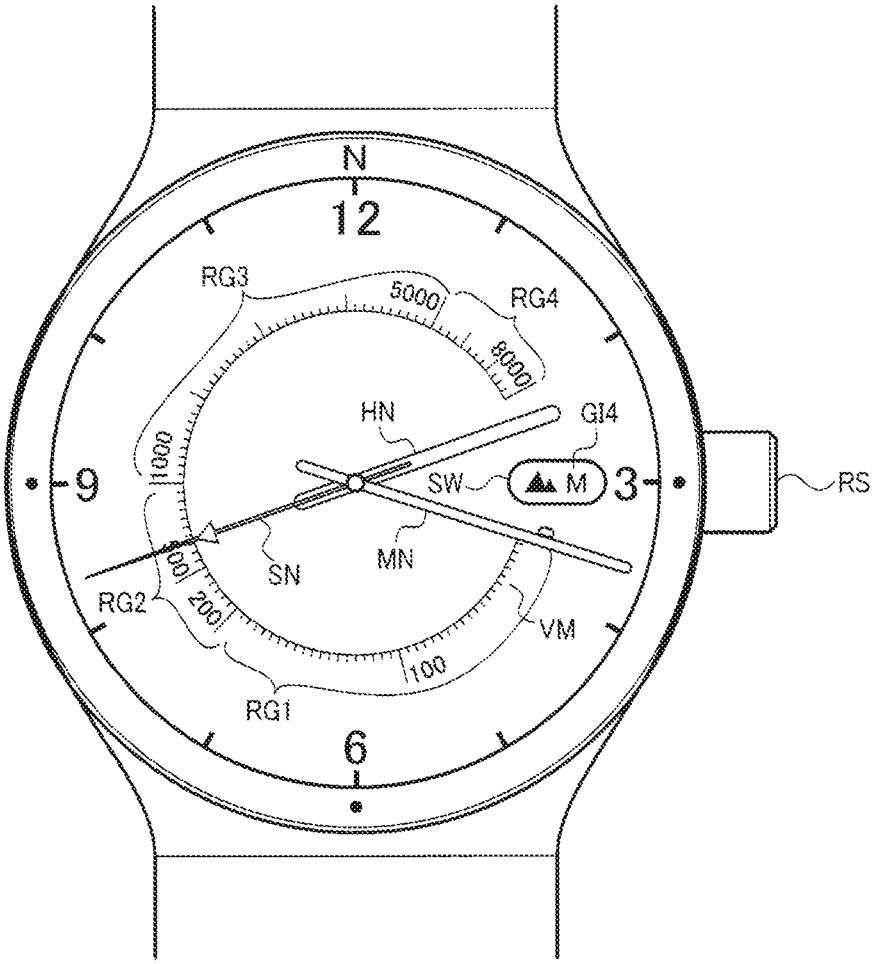
FIG. 6 describes an altitude display mode.

Further, the user can operate the crown RS to set the wristwatch-shaped terminal apparatus in a mode in which information other than the time or the pulse rate is displayed, as shown, for example, in FIG. 6. In the case shown in FIG. 6, the wristwatch-shaped terminal apparatus is set in a mode in which the height above sea level is displayed. In this example, the hour hand HN points at an upper limit value of a measurement range of the height above sea level, the minute hand MN points at a lower limit value of the measurement range of the height above sea level, and the second hand SN points at a measured value of the height above sea level. Since FIGS. 4 and 6 differ from each other in terms of the type of displayed information, the measurement ranges differ from each other. Therefore, the upper limit values of the measurement ranges that the hour hand HN points at differ from each other, and the lower limit values of the measurement ranges that the minute hand MN points at differ from each other.

As described above, in the wearable terminal apparatus according to the present embodiment, the hour hand HN and the minute hand MN indicate a measurement range appropriate for the type of displayed information to allow the user to readily read a measured value that the scone hand SN points at. The wearable terminal apparatus according to the present embodiment can therefore display a plurality of pieces of information in such a way that the user can readily identify the information with no increase in the number of on-dial markings or the number of indication hands.

2. Example of System Configuration

Figure 1:
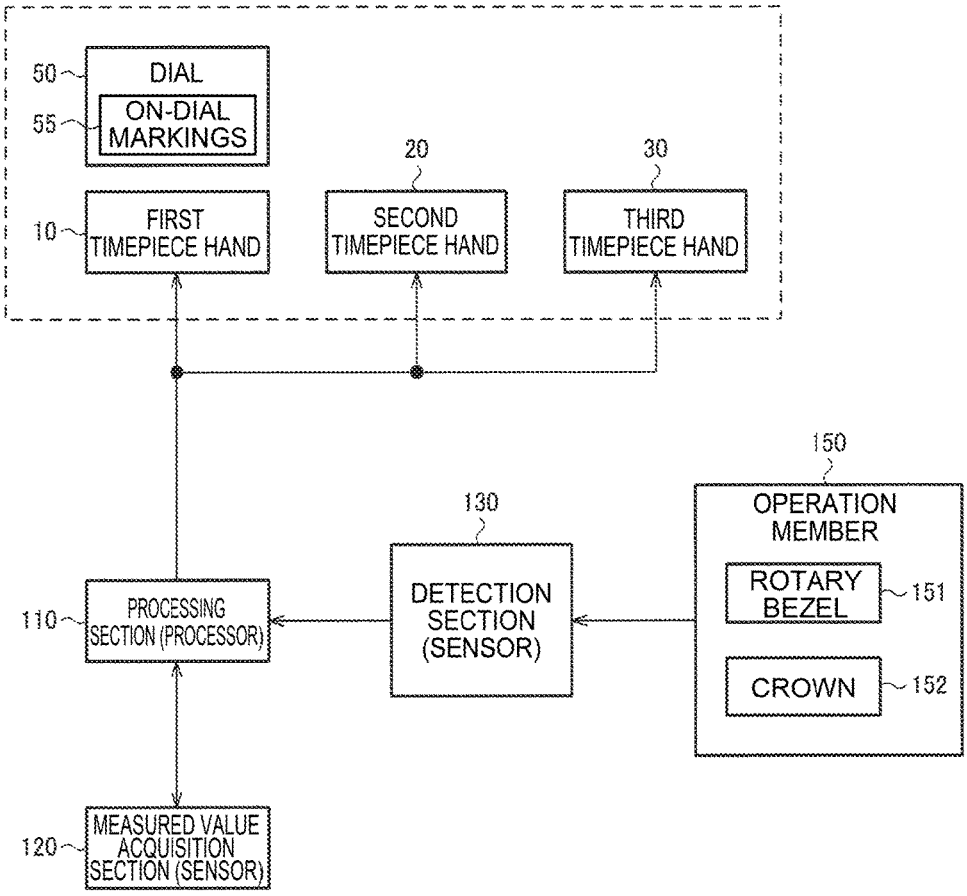
FIG. 1 describes an example of a system configuration according to an embodiment of the invention.

Next, FIG. 1 shows an example of the configuration of a wearable terminal apparatus (wristwatch-shaped terminal apparatus, electronic instrument) 100 according to the present embodiment. The wearable terminal apparatus 100 according to the present embodiment includes an enclosure 70 (shown in FIG. 2) and a dial 50, which has on-dial markings 55 and is provided in the enclosure 70, a first timepiece hand 10, a second timepiece hand 20, a third timepiece hand 30, a processing section 110, and a measured value acquisition section 120, as shown in FIG. 1. The wearable terminal apparatus 100 may further include a detection section 130 and an operation member 150. The operation member 150 includes, for example, a rotary bezel 151 and a crown 152. The wearable terminal apparatus 100 does not necessarily have the configuration shown in FIG. 1, and a variety of variations are conceivable. That is, part of the constituent elements described above can be omitted, and another constituent element can be added. For example, the wearable terminal apparatus 100 may, for example, include a storage section that is not shown.

Figure 2:
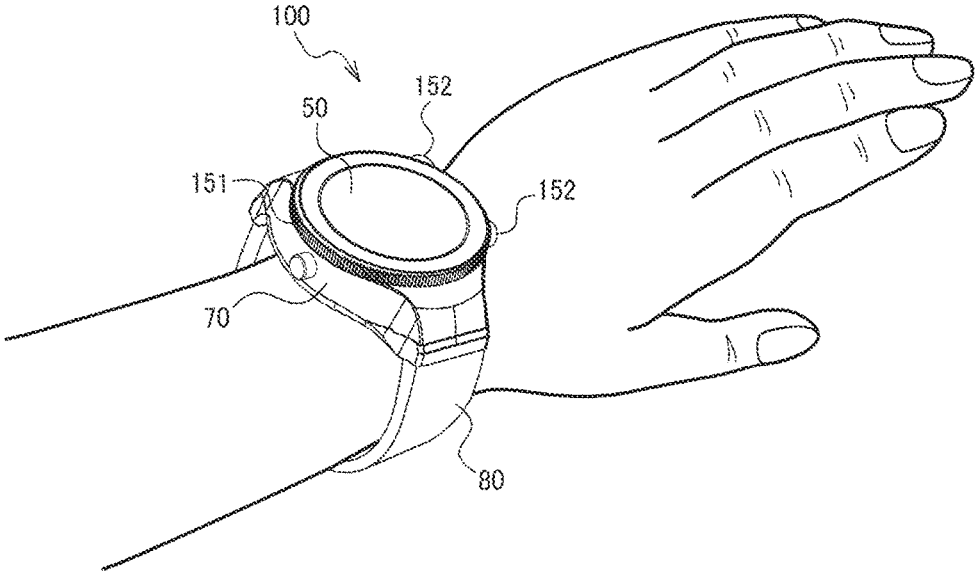
FIG. 2 describes an example of a specific configuration of a wristwatch-shaped terminal apparatus.

For example, in the case where the wearable terminal apparatus 100 is a wristwatch-shaped terminal apparatus, the wristwatch-shaped terminal apparatus 100 includes the enclosure 70 and a band section 80, which is attached to the enclosure 70, as shown in FIG. 2. The enclosure 70 corresponds to a main body section of the wristwatch-shaped terminal apparatus 100 and is provided with the operation member 150, such as the rotary bezel 151 and the crown 152, and the dial 50. The enclosure 70 may further incorporate the processing section 110, the measured value acquisition section 120, and other components. For example, the enclosure 70 may incorporate a substrate (circuit substrate) on which the processing section 110 is mounted. The band section 80 is, for example, wound around the user's (wearer's) wrist to fix the wristwatch-shaped terminal apparatus 100, as shown in FIG. 2.

Each of the sections of the wearable terminal apparatus 100 will next be described.

Figure 3:
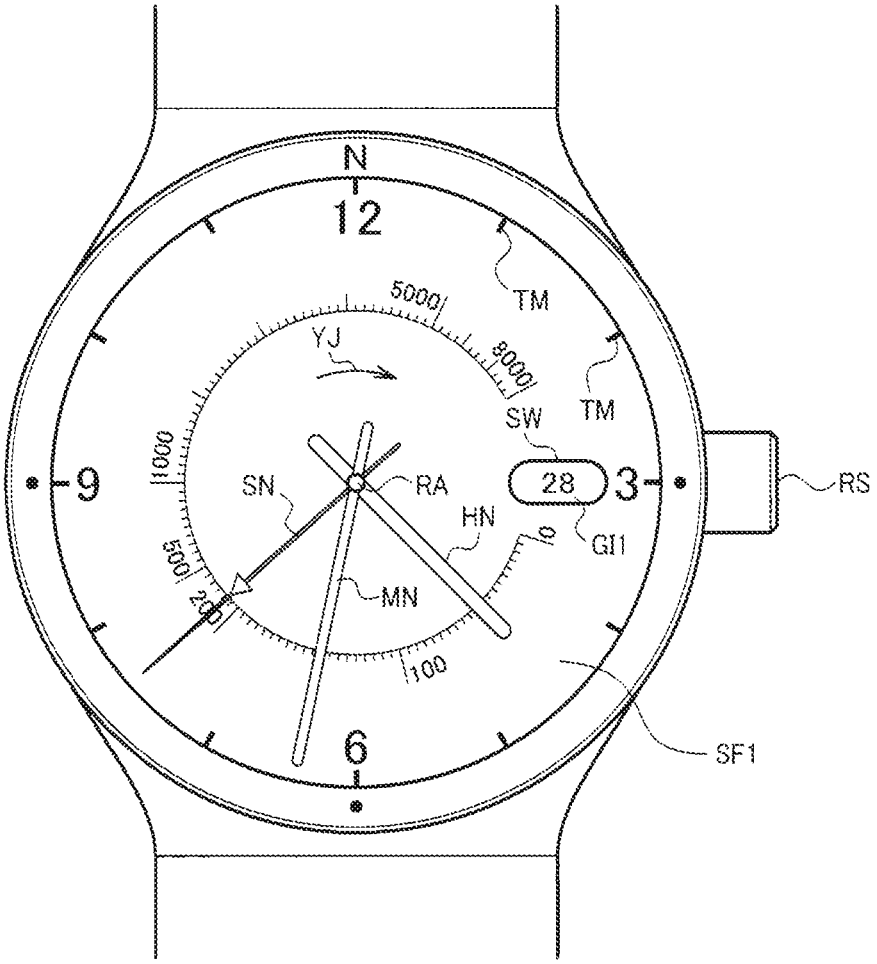
FIG. 3 describes a time display mode.

The first timepiece hand 10, the second timepiece hand timepiece hand 20, and the third timepiece hand 30 are, for example, timepiece hands (indication hands) rotatable around the same predetermined axis of rotation. For example, the first timepiece hand 10 is one of the hour hand HN and the minute hand MN, the second timepiece hand 20 is the other one of the hour hand HN and the minute hand MN, and the third timepiece hand 30 is the second hand SN, as shown in FIG. 3. The first timepiece hand 10, the second timepiece hand 20, and the third timepiece hand 30 are fixed to the dial 50 via a predetermined shaft RA, as shown, for example, in FIG. 3. The predetermined shaft RA is a shaft so provided as to be perpendicular to a first surface SF1, which is a surface of the dial 50 and on which the on-dial markings 55 are provided, and is rotatable in a direction YJ parallel to the first surface SF1. Time can thus be displayed, as shown in FIG. 3.

The dial (display surface) 50 is a surface so positioned as to be visually recognized by the user and having the on-dial markings 55, as in the example shown, for example, in FIG. 2. The on-dial markings 55 are indications representing a measurement range of a measured value. The on-dial markings 55 may, for example, be printed on the dial 50, may be protrusions or engraved marks provided on the dial 50, or may be stickers attached thereto. When the dial 50 is a display section, for example, a liquid crystal display, the on-dial markings 55 may be an image displayed in the display section.

The processing section 110 controls rotation of the first timepiece hand 10, the second timepiece hand 20, and the third timepiece hand 30. The processing section 110 may be a processor achieved by using any of a variety of configurations, such as a hardware circuit formed of a CPU (central processing unit), a GPU (graphics processing unit), a DSP (digital signal processor), or an ASIC (application specific integrated circuit). Although not shown in FIG. 1, the wearable terminal apparatus 100 includes a drive mechanism that drives and rotates the first timepiece hand 10 to the third timepiece hand 30. The processing section 110 controls the drive mechanism to place each of the first timepiece hand 10 to the third timepiece hand 30 in a predetermined position. In this case, the processing section 110 may include an analog circuit that drives the drive mechanism.

The measured value acquisition section 120 acquires a measured value. For example, the measured value acquisition section 120 acquires at least one of living body detection information, activity detection information, and environment detection information as the measured value.

The living body detection information is, for example, information on the living body of the wearer (user) of the wearable terminal apparatus 100. The living body detection information is, for example, sensor detection information measured, for example, with a pulse wave sensor provided in the wearable terminal apparatus 100 and information inputted by the user. Specific examples of the living body detection information may include information on the pulse rate (pulse wave, pulse) and blood pressure. In the case where the measured value acquisition section 120 acquires the living body detection information, the measured value acquisition section 120 may be a living body sensor, such as a pulse wave sensor.

The activity detection information is, for example, information on a result of activity performed by the wearer (user) of the wearable terminal apparatus 100. The activity detection information is, for example, sensor detection information measured, for example, with an acceleration sensor provided in the wearable terminal apparatus 100 and information inputted by the user. Specific examples of the activity detection information may include information on the step count and the travel. In the case where the measured value acquisition section 120 acquires the activity detection information, the measured value acquisition section 120 may, for example, be an acceleration sensor.

The environment detection information is, for example, information on the environment around the wearable terminal apparatus 100. Specific examples of the environment detection information may include information on air temperature, humidity, height above sea level, atmospheric pressure, and orientation (direction), which are acquired with a temperature sensor, a humidity sensor, an atmospheric sensor, and an orientation sensor provided in the wearable terminal apparatus 100. The environment detection information may instead, for example, be information that can be acquired from an electronic instrument (server, for example) connected to the wearable terminal apparatus 100 over a network. In the case where the measured value acquisition section 120 acquires the environment detection information, the measured value acquisition section 120 may be a temperature sensor, a humidity sensor, an atmospheric sensor, an orientation sensor, or any other sensor.

The measured value acquisition section 120 may include a plurality of sensors. The measured value acquisition section 120 may instead be a connection section that is communicably connected to a variety of sensors and receives sensor information from the variety of sensors.

Information other than time, that is, at least one of the living body detection information, the activity detection information, and the environment detection information can thus be displayed or otherwise indicated.

The operation member 150 is, for example, a member rotatable around a predetermined axis of rotation. For example, the operation member 150 includes the rotary bezel 151 and the crown 152, as described above. The operation member 150 is not limited thereto and may, for example, be a button or a switch.

The rotary bezel 151 is a member corresponding to a frame of the enclosure 70 (dial 50 in a narrow sense) and is provided in a position corresponding to a circumferential edge portion of the enclosure 70, particularly, the outer circumference of the dial 50. In particular, the rotary bezel 151 according to the present embodiment is a rotary bezel rotatable around a predetermined axis of rotation. The predetermined axis is, for example, an axis extending in a direction that intersects the dial 50. In a narrow sense, the predetermined axis is, for example, an axis extending in the direction perpendicular to the first surface SF1, on which the on-dial markings 55 of the dial 50 are provided, as shown, for example, in FIG. 3. It is, however, noted in the approach of the present embodiment that the rotary bezel may be replaced with another rotary member.

The crown 152 is, for example, a protruding portion provided in a side surface portion of the enclosure 70, as shown in FIG. 2. The crown 152 is rotatable around a predetermined axis of rotation. The predetermined axis is, for example, an axis extending in a direction that intersects the side surface portion of the enclosure 70. In a narrow sense, the predetermined axis is, for example, an axis extending in the direction perpendicular to the side surface portion of the enclosure 70. The position of the crown 152 relative to the side surface portion of the enclosure 70 may be variable, that is, the crown 152 may, for example, be pushed in or pulled out. It is, however, noted in the approach of the present embodiment that the crown 152 may be replaced with another member, such as a button or a switch.

The detection section 130 detects operation performed by use of the operation member 150. For example, the detection section 130 detects operation of rotating the operation member 150 rotatable around the predetermined axis of rotation. For example, in the case where the operation member 150 includes the rotary bezel 151, the wearable terminal apparatus 100 may include a pulse count detection sensor that is not shown as the detection section 130. A predetermined optical pattern is provided on the lower surface of the rotary bezel 151, and the pulse count detection sensor irradiates the lower surface of the rotary bezel 151 with light and detects the light reflected off the lower surface. In this configuration, since the pulse count detected with the pulse count detection sensor correlates with the amount of rotation of the rotary bezel 151, the state of the rotation (the direction of the rotation and the amount of the rotation in a narrow sense) of the rotary bezel 151 can be detected on the basis of information from the sensor. The approach to detection of the state of the rotation of the rotary bezel in the present embodiment is not limited to the approach described above, and a wide variety of other widely-known approaches to detection of the state of rotation of a rotary bezel (for example, detection approach based on mechanical structure) are applicable. The detection section 130 in the present embodiment can therefore be achieved, for example, by a variety of sensors used in a variety of approaches. The same holds true for detection of the rotation of the crown 152.

3. Details of Processes

Processes carried out in the present embodiment will next be described in detail. The wearable terminal apparatus 100 according to the present embodiment can be set in the time display mode in which time is displayed and modes in which information other than time is displayed, as described above. For example, FIG. 3, which has been described above, shows the dial, the first timepiece hand, the second timepiece hand, and the third timepiece hand in the case where the time display mode is set. Further, in the case shown in FIG. 3, the first surface SF1 of the dial is provided with a small window SW, through which a set mode is displayed. In the present case, to show the user that the time display mode has been set, numeral information GI1 ("28"), which represents the date of the day, is displayed through the small window SW. The user can grasp that the wearable terminal apparatus 100 is currently set in the time display mode by checking the numeral information.

In the case shown in FIG. 3, the first timepiece hand is, for example, the hour hand HN and points at the current time in the form of markings TM that represent 12 hours in one round. The second timepiece hand is, for example, the minute hand MN and points at the current time in the form of the markings TM that represent 1 hour in one round. The third timepiece hand is, for example, the second hand SN and points at the current time in the form of the markings TM that represent 1 minute in one round.

A description will next be made of a case where the wearable terminal apparatus 100 is set in a mode in which information other than time is displayed (a variety of measured values are displayed). In this case, the processing section 110 controls the timepiece hands in such a way that among the on-dial markings 55, the first timepiece hand 10 is placed (set) in a position corresponding to a lower limit value of a measured value, the second timepiece hand 20 is placed (set) in a position corresponding to an upper limit value of the measured value, and the third timepiece hand 30 is placed (set) in a position corresponding to the measured value. Each process in the present embodiment carried out by the processing section 110 (processor) is carried out on the basis of information (a variety of data or programs) stored in a storage section (memory) that is not shown.

A specific example will be described with reference, for example, to FIG. 4. FIG. 4 shows an example in which the pulse rate (heart rate, BPM) is displayed. That is, in the example shown in FIG. 4, the wearable terminal apparatus 100 is set in a pulse display mode, which will be described later. In the case where the wearable terminal apparatus 100 is set in the pulse display mode, the processing section 110 displays information GI2, which represents that the wearable terminal apparatus 100 is set in the pulse display mode, through the small window SW. The user can grasp that the wearable terminal apparatus 100 is currently set in the pulse display mode by visually recognizing the information GI2.

In the case shown in FIG. 4, the hour hand HN and the minute hand MN indicate, for example, a range (measurement range) where fat is burned efficiently at the time of exercise. The measurement range in the example shown in FIG. 4 is not a measurable range but is a range within which a measured value desirably falls. That is, the upper limit value of the measurement range in the example shown in FIG. 4 is a value representing an ideal upper limit of the pulse rate at the time of exercise, and the lower limit value of the measurement range in the example shown in FIG. 4 is a value representing an ideal lower limit of the pulse rate at the time of exercise. It is, however, noted that the measurement range may instead be a range within which the pulse rate of a subject who is in a healthy state typically can fall, for example, in the example shown in FIG. 4. Still instead, the measurement range may be a range over which a measured value is obtainable or a range within which a measured value can fall as in the examples shown in FIGS. 5 and 6, which will be described later.

Specifically, in the example shown in FIG. 4, the processing section 110 controls the rotation of the hour hand HN in such a way that the hour hand HN points at an ideal upper limit value of the pulse rate among the on-dial markings VM and controls the rotation of the minute hand MN in such a way that the minute hand MN points at an ideal lower limit value of the pulse rate among the on-dial markings VM. As a result, for example, in the example shown in FIG. 4, the user can identify that an ideal measurement range of the pulse rate at the time of exercise ranges from a value close to 55 to a value somewhere around 150.

In the example shown in FIG. 4, the second hand SN points at a measured pulse rate. Specifically, the processing section 110 controls the rotation of the second hand SN in such a way that the second hand SN points at a measured value of the pulse rate among the on-dial marking VM. The user can therefore grasp the measured value of the pulse rate by reading the value that the second hand SN points at.

Figure 5:
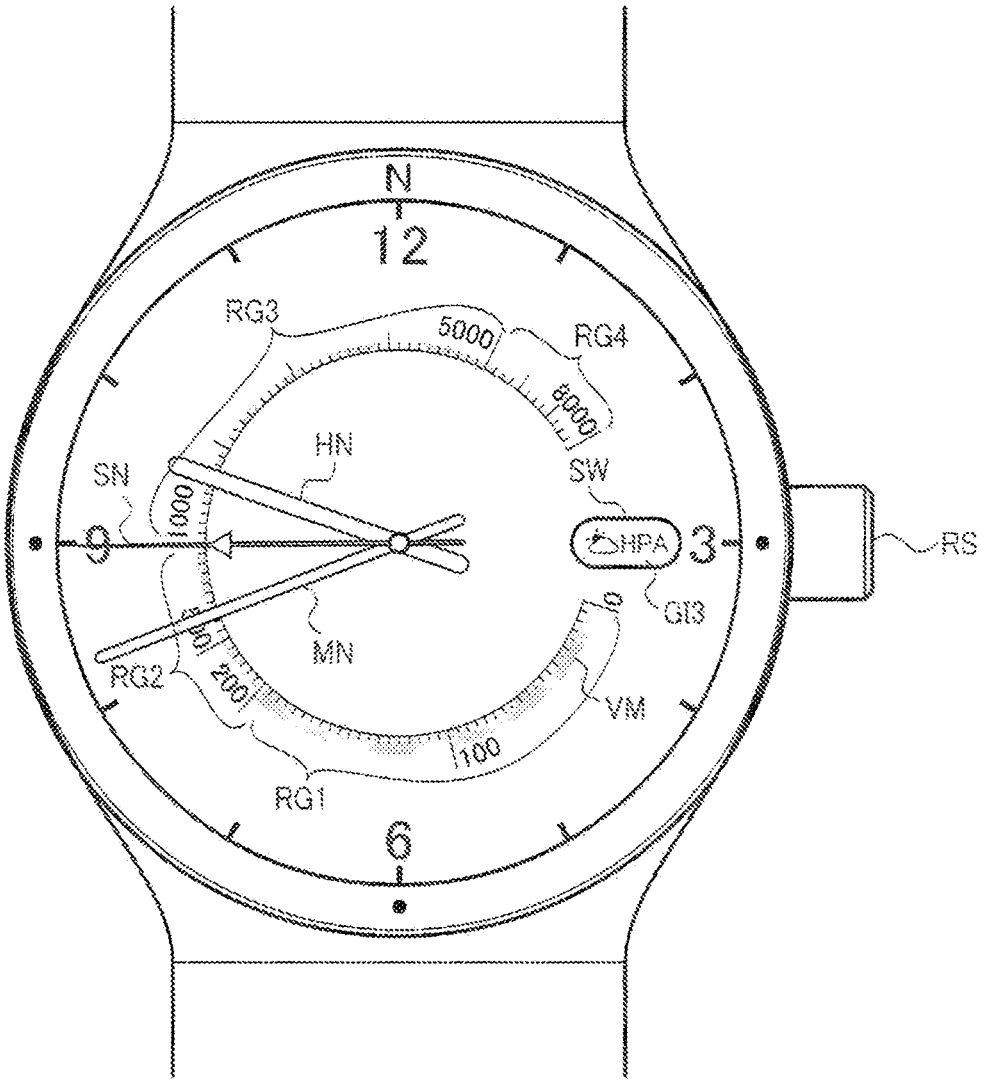
FIG. 5 describes an atmospheric pressure display mode.

Further, in the present embodiment, also in a case where information other than time and the pulse rate is displayed, the first timepiece hand (minute hand MN), the second timepiece hand (hour hand HN), the third timepiece hand (second hand SN), and the same on-dial markings VM display a measurement range and a measured value, as shown in FIGS. 5 and 6, which will be described later, as in the example shown in FIG. 4.

In the present embodiment, since a measured value is displayed, for example, by use of the on-dial markings broadly arranged over the entire dial, the user can readily identify a measured value. Further, no display member for displaying a measured value is required except the on-dial markings and the three timepiece hands. A plurality of pieces of information can therefore be so displayed as to be readily identified by the user with no increase in the number of on-dial markings or the number of indication hands.

As described above, in the wearable terminal apparatus 100 according to the present embodiment, since the single set of on-dial markings 55 is shared to display a plurality of pieces of information including the time information, different on-dial markings do not need to be prepared for different types of information. Therefore, the manufacturing cost of the wearable terminal apparatus 100 can be reduced and other advantages are provided.

Further, since the same on-dial markings are used, the user is not confused about which on-dial markings the user should look at when the type of displayed information is changed. Moreover, there is no difficulty identifying which on-dial marking an indication hand (timepiece hand) points at and determining a value corresponding to the on-dial marking.

Further, the dial does not need to be provided with small windows for different types of information, whereby decrease in size of displayed information can be avoided. Moreover, since a plurality of small windows are not required, the flexibility of the design of the dial can be increased. Further, manufacturing cost of the dial can be reduced.

The processing section 110 switches the display mode between a first display mode in which a first measured value is displayed and a second display mode in which a second measured value is displayed, as described above. The first display mode and the second display mode differ from each other in terms of the positions where the first timepiece hand 10 and the second timepiece hand 20 are placed among the on-dial markings 55.

Therefore, measured values of at least two types of information can be displayed or otherwise indicated.

For example, the first display mode and the second display mode are two display modes out of an altitude display mode, an atmospheric pressure display mode, the pulse display mode, a step count display mode, and a distance display mode.

The example shown in FIG. 4 described above is an example of the case where the wearable terminal apparatus 100 is set in the pulse display mode. For example, in the case where the first display mode is the pulse display mode shown in FIG. 4, the first measured value is the pulse rate (bpm). The example shown in FIG. 5 is an example of the case where the wearable terminal apparatus 100 is set in the atmospheric pressure display mode. For example, in the case where the second display mode is the atmospheric pressure display mode shown in FIG. 5, the second measured value is the atmospheric pressure (hPa).

In the present embodiment, the wearable terminal apparatus 100 may be capable of switching the display mode among two or more display modes. For example, in the example shown in FIG. 6, the wearable terminal apparatus 100 is set in the altitude display mode, and the measured value displayed in this case is altitude (height above sea level) (m). Although the step count display mode and the distance display mode are not shown, in the case where the wearable terminal apparatus 100 is set in the step count display mode, the step count (steps) is displayed as the measured value, and in the case where the wearable terminal apparatus 100 is set in the distance display mode, the travel (km) is displayed as the measured value.

Figure 7:
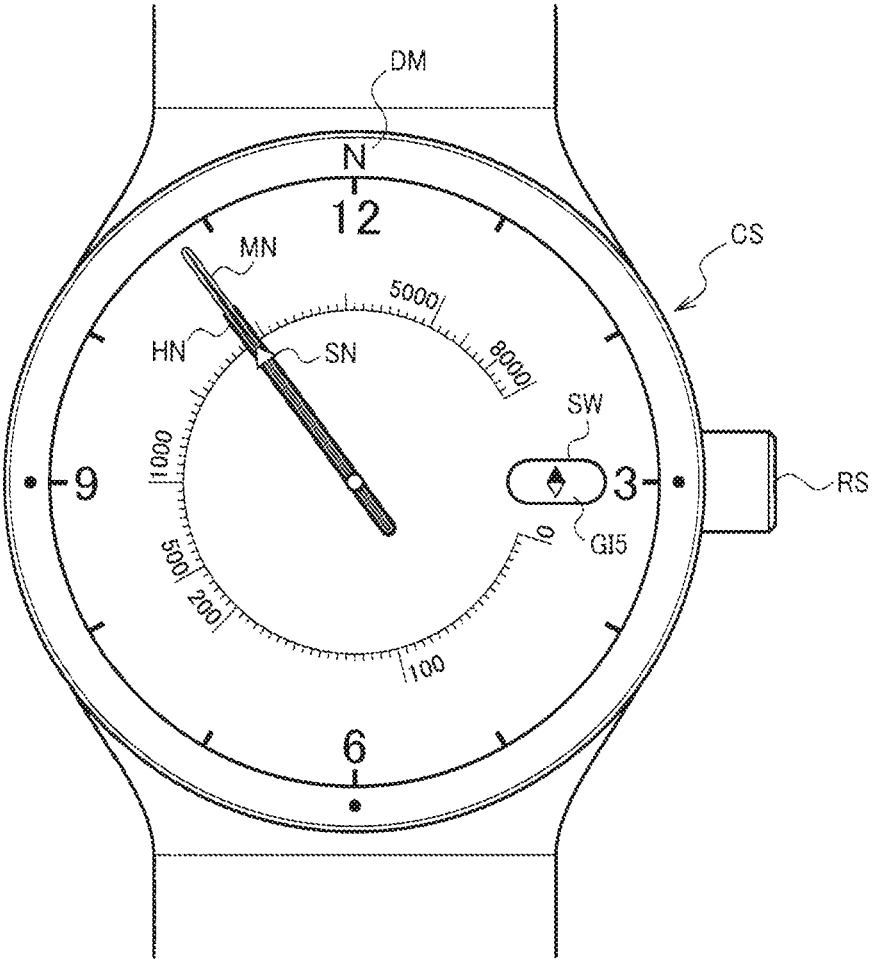
FIG. 7 describes an orientation display mode.

Further, the wearable terminal apparatus 100 according to the present embodiment can be set in an orientation display mode, which will be described later with reference to FIG. 7, and a measured period display mode (stopwatch mode), which will be described later with reference to FIG. 8. For example, in the case where the wearable terminal apparatus 100 is set in the orientation display mode, the orientation is displayed as the measured value, and in the case where the wearable terminal apparatus 100 is set in the measured period display mode, a measured period measured by the stopwatch function is displayed as the measured value.

Therefore, at least two measured values, for example, out of the altitude, atmospheric pressure, pulse rate, step count, and travel can be displayed or otherwise indicated.

In the case where the detection section 130 detects operation of rotating the operation member 150, the processing section 110 switches the display mode between the first display mode and the second display mode. The rotation operation is, for example, operation of rotating the rotary bezel and operation of rotating the crown RS shown in FIG. 4 described above.

The user can thus switch or otherwise change the display mode by performing simple operation of rotating the rotary bezel or the crown.

In the case where the display mode is switched, guide information representing a display mode after the switching is displayed through the small window or any other opening provided, for example, in the dial, as described above. For example, in the example shown in FIG. 4, a heart-shaped icon image representing that the display mode is the pulse display mode and an object GI2 formed of a text "BPM" are displayed as the guide information through the small window SW.

Similarly, in the example shown in FIG. 5, a cloud/sun-shaped icon image representing that the display mode is the atmospheric pressure display mode and an object GI3 formed of a text "hPa" are displayed as the guide information through the small window SW. Further, for example, in the example shown in FIG. 6, a mountain-shaped icon image representing that the display mode is the altitude display mode and an object GI4 formed of a text "M" are displayed as the guide information through the small window SW.

In the first display mode and the second display mode, to display different measurement ranges, the first timepiece hand and the second timepiece hand are placed in different positions in the two display modes. That is, the processing section 110 controls the first and second timepiece hands in the first display mode in such a way that the first timepiece hand 10 is placed in a position corresponding to the lower limit value of a first measurement range corresponding to the first measured value and the second timepiece hand 20 is placed in a position corresponding to the upper limit value of the first measurement range. On the other hand, the processing section 110 controls the first and second timepiece hands in the second display mode in such a way that the first timepiece hand 10 is placed in a position corresponding to the lower limit value of a second measurement range corresponding to the second measured value and the second timepiece hand 20 is placed in a position corresponding to the upper limit value of the second measurement range.

For example, in the case where the first display mode is the pulse display mode shown in FIG. 4 and the second display mode is the atmospheric pressure display mode shown in FIG. 5, the first measured value is the pulse rate (bpm) and the second measured value is the atmospheric pressure (hPa), as in the example described above. It is then assumed that, for example, the first timepiece hand 10 pointing at the lower limit value of the measurement range is the minute hand MN and the second timepiece hand 20 pointing at the upper limit value of the measurement range is the hour hand HN. In this case, in the example shown in FIG. 4, the processing section 110 places the hour hand HN in such a way that it points at an ideal upper limit value of the pulse rate (value somewhere around 150, for example) and places the minute hand MN in such a way that it points at an ideal lower limit value of the pulse rate (value close to 55, for example) among the on-dial markings VM. On the other hand, in the example shown in FIG. 5, the processing section 110 places the hour hand HN in such a way that it points at the upper limit value of the atmospheric pressure (value close to 1600, for example) and places the minute hand MN in such a way that it points at the lower limit value of the atmospheric pressure (value close to 675, for example) among the on-dial markings VM.

The first timepiece hand and the second timepiece hand thus allow a measurement range appropriate for (corresponding to) each measured value to be displayed or otherwise indicated. To display the upper limit value and the lower limit value of a measurement range, it is conceivable to employ an approach in which part of the dial 50 or the on-dial markings 55 is lighted up and off instead of the approach in which the two timepiece hands are used as described above.

In the present embodiment, the hour hand HN, the minute hand MN, the second hand SN, and the common on-dial markings VM are used to display a plurality of types of measured value, and the measurement ranges differ from one another depending on the type of the measured value, as shown in FIGS. 4 to 6. For example, the measurement range in the pulse display mode shown in FIG. 4 described above is the range from 55 to 150 out of the on-dial markings VM, and the measurement range in the atmospheric pressure display mode shown in FIG. 5 is the range from 675 to 1600 out of the on-dial markings VM. The measurement range in the altitude display mode shown in FIG. 6 is a range from 0 to 8000 out of the on-dial markings VM.

Since the width of the measurement range in a display mode differs from the widths of the measurement ranges in the other display modes, configuring the commonly used on-dial markings VM in such a way that the numeral represented by one marking VM is fixed undesirably makes the measurement range indicated by the hour hand HN and the minute hand MN too narrow in some cases. For example, comparison between the measurement range of the pulse rate shown in FIG. 4 with the measurement range of the altitude shown in FIG. 6 shows that the measurement range of the pulse rate is about 1/80 of the measurement range of the altitude. Configuring the on-dial markings VM in such a way that the numeral represented by one marking VM is fixed therefore undesirably makes it difficult to visually recognize the measurement range of the pulse rate indicated by the hour hand HN and the minute hand MN.

Therefore, in the present embodiment, the numeral represented by each of the on-dial markings 55 changes on a predetermined range basis. That is, the on-dial markings 55 in a first range of the dial 50 differ from those in a second range of the dial 50 in terms of the magnitude of the numeral represented by one marking.

For example, the on-dial markings VM shown in FIGS. 4 to 6 has a first range RG1 to a fourth range RG4, and the magnitude of the numeral represented by one marking varies in the first range RG1 to the fourth range RG4. Specifically, in the first range RG1, the numeral represented by one marking is 5, and in the second range RG2, the numeral represented by one marking is 50. In the third range RG3, the numeral represented by one marking is 100, and in the fourth range RG4, the numeral represented by one marking is 250.

As described above, it is desirable that in a measurement range over which a measured value changes by a relatively small amount, the numeral represented by each of the on-dial markings VM is set at a small value, whereas in a measurement range over which a measured value changes by a relatively large amount, the numeral represented by each of the on-dial markings VM is set at a large value.

Specifically, in the example shown in FIG. 4, the on-dial markings VM are so provided that the measurement range of the pulse rate, which changes by a relatively small amount, falls within the first range RG1. In the example shown in FIG. 5, the on-dial markings VM are so provided that the measurement range of the atmospheric pressure, which changes by a relatively large amount, spans the second range RG2 and the third range RG3. In the altitude display mode shown in FIG. 6, since the altitude measurement range is broad, the entire range from the first range RG1 to the fourth range RG4 is used as the altitude measurement range.

As a result, even when a plurality of types of measured value are displayed by using common on-dial markings, each measured value and measurement range can be readily read or otherwise recognized.

In the present embodiment, the hour hand HN, the minute hand MN, and the second hand SN display a measured value and a measurement range, as described above. In many cases, the hour hand HN, the minute hand MN, and the second hand SN are so provided as to be capable of pointing the time representing markings TM arranged in a circular pattern, as shown in FIG. 3.

In the present embodiment, the on-dial markings 55 for displaying a variety of measured values are also arranged on the dial 50 in a circular or arcuate pattern. For example, the on-dial markings VM are arranged on the dial in a circular pattern inside (or outside) the time representing markings TM, as shown in FIGS. 4 to 6.

A measured value and a measurement range can thus be displayed or otherwise indicated by using the hour hand, the minute hand, and the secondhand. That is, a measured value and a measurement range can thus be displayed or otherwise indicated without a large amount of change of the configuration of the hour hand, the minute hand, and the second hand from the configuration of them of a typical timepiece.

Further, in the present embodiment, the wearable terminal apparatus 100 can be set in the orientation display mode, as described above, in addition to the display modes described above. A specific example is shown in FIG. 7. In the case where the wearable terminal apparatus 100 can be set in the orientation display mode, display objects DM, which represent the orientation, are provided in a circumferential edge portion of an enclosure CS (or circumferential edge portion of dial). The display objects DM may, for example, be engraved marks or protrusions provided in the circumferential edge portion or any other portion of the enclosure CS, objects printed therein, or stickers attached thereto.

When the user operates the crown RS to set the wearable terminal apparatus 100 in the orientation display mode, an icon image GI5, which has the shape of an orientation compass needle and represents that the wearable terminal apparatus 100 is set in the orientation display mode, is displayed through the small window SW. Further, the processing section 110 control the timepiece hands on the basis of orientation detection information measured, for example, with an orientation sensor in such a way that the hour hand HM, the minute hand MN, and the second hand SN point, for example, at the true north. The user changes the orientation of the wearable terminal apparatus 100 in such a way that the three timepiece hands point at the position corresponding to the display object (N) representing the north among the orientation representing display objects DN. When the three timepiece hands point at the position corresponding to the display object (N) representing the north among the display objects DM, the user can grasp the orientation with the wearable terminal apparatus 100 oriented toward the true north by checking the display objects DM.

Figure 8:
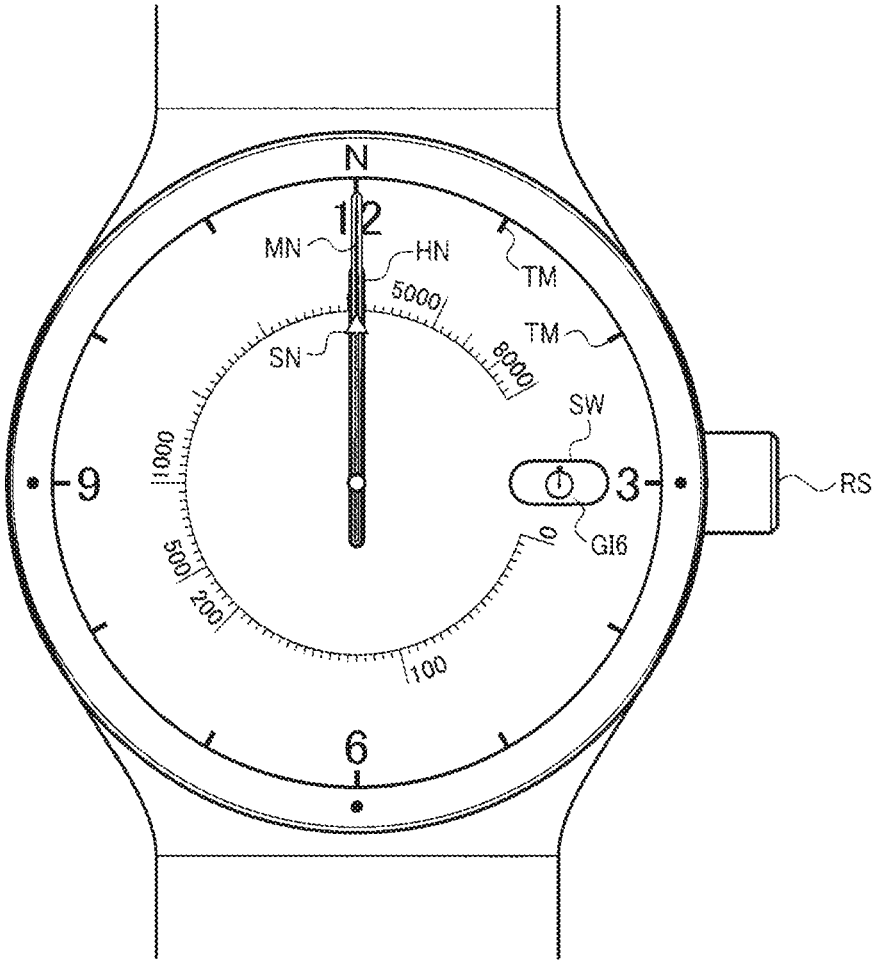
FIG. 8 describes a measured period display mode.

Further, in the present embodiment, the wearable terminal apparatus 100 can be set in the measured period display mode (stopwatch mode), as shown in FIG. 8. In the measured period display mode, when the user operates the crown RS to set the wearable terminal apparatus 100 in the measured period display mode, an icon image GI6, which has the shape of a stopwatch and represents that the wearable terminal apparatus 100 is set in the measured period display mode, is displayed through the small window SW, as shown in FIG. 8. Thereafter, when the user presses down or otherwise operates the crown RS, the measurement starts, and the processing section 110 carries out a process of placing the timepiece hands (hour hand HM, minute hand MN, and second hand SN) in positions representing a measured period. The measured period is displayed by the timepiece hands each of which points at one of the time representing markings TM. Further, when the user presses down or otherwise operates the crown RS again, the measurement is terminated. The user can grasp the measured period by reading values that the timepiece hands point at.

4. Variations

Variations of the present embodiment will next be described.

Figure 9:
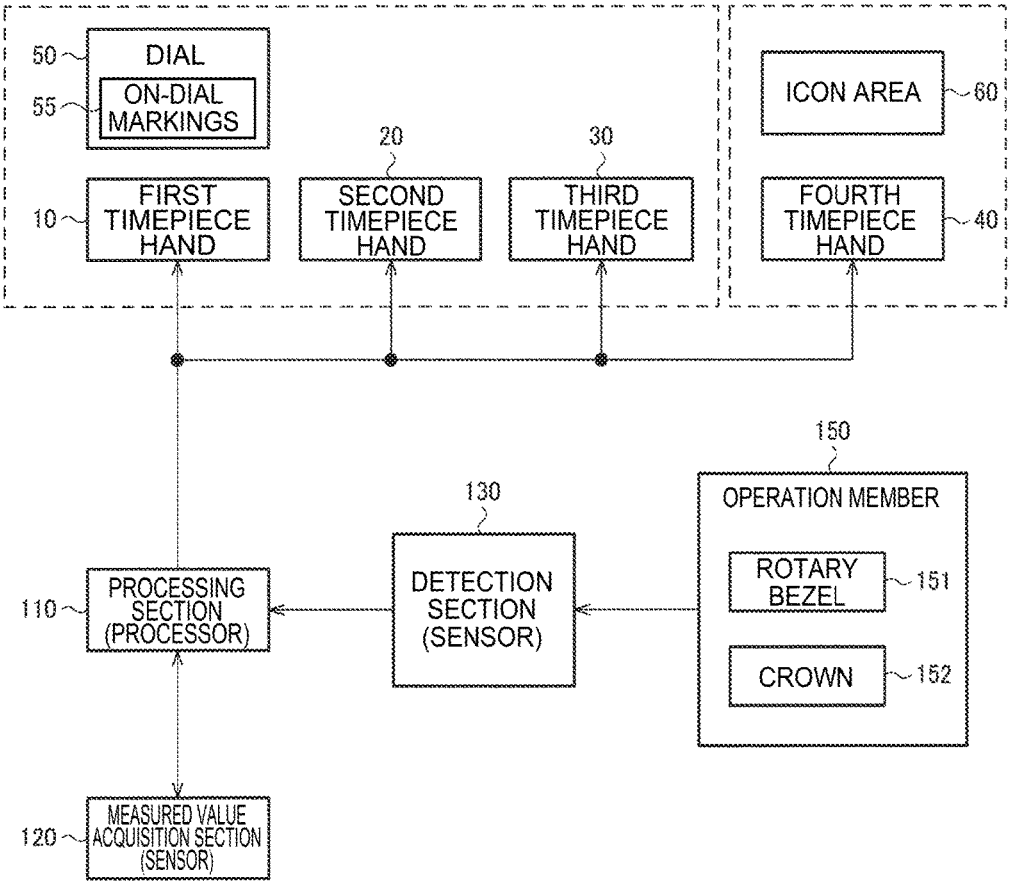
FIG. 9 describes an example of a system configuration according to a variation of the embodiment.

In a variation of the present embodiment, the wearable terminal apparatus 100 includes a fourth timepiece hand 40 and an icon area 60, which is provided in correspondence with the fourth timepiece hand 40 and in which a plurality of icons are provided, as shown in FIG. 9.

The processing section 110 then controls the fourth timepiece hand 40 in such a way that the fourth timepiece hand 40 is placed in the icon area 60 and in a position corresponding to an icon selected from the plurality of icons.

Figure 10:
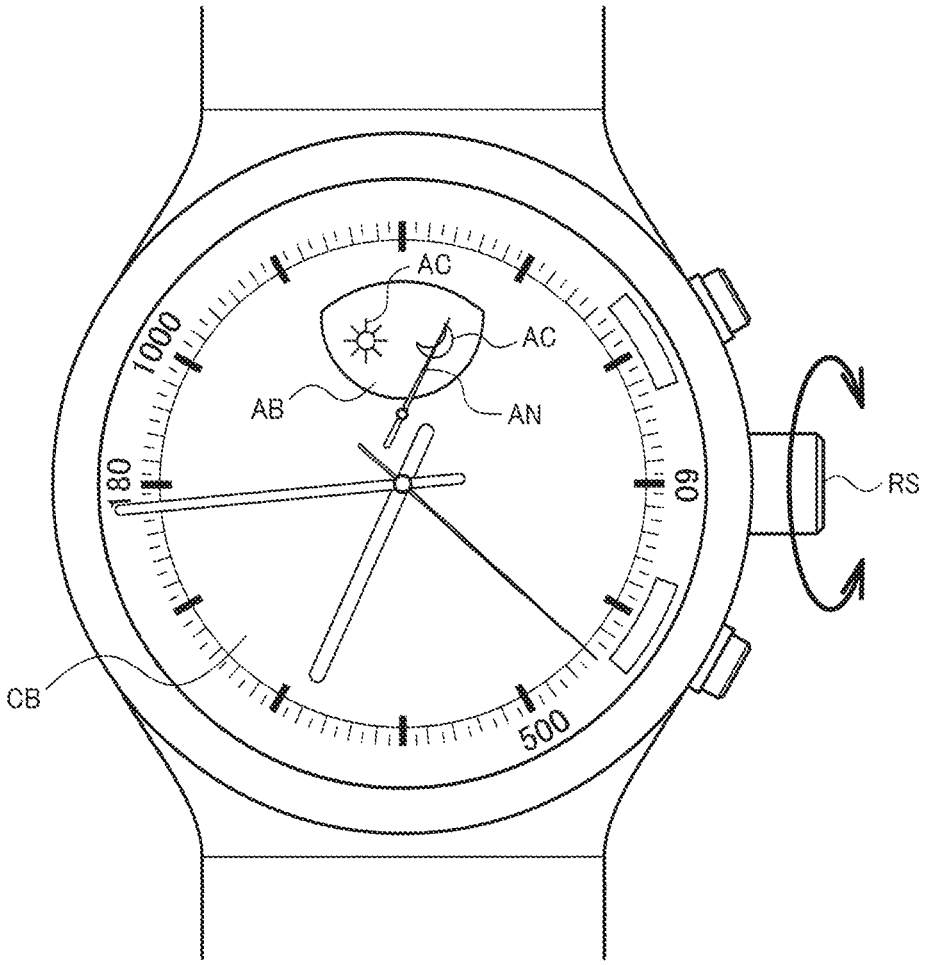
FIG. 10 describes a mode in which an icon representing the daytime and nighttime is displayed in an icon area.

A specific example is shown in FIG. 10. In the example shown in FIG. 10, an icon area AB is provided, for example, in a position corresponding to a small window that opens through part of a dial CB. That is, a small window is so provided as to open through the dial CB, and the icon area AB is provided below the small window. The small window, which opens through the dial CB, allows the user to visually recognize the icon area AB provided below the dial CB. It is, however, noted that the icon area AB is not limited to the configuration shown in the example illustrated in FIG. 10. For example, the icon area AB may be a predetermined area of the dial CB or a plate-shaped member provided on the dial CB. That is, a variety of variations of the icon area AB are conceivable.

An icon AC representing the daytime and nighttime is provided in the icon area AB shown in FIG. 10. The icon AC may, for example, be engraved marks or protrusions provided in the icon area AB, objects printed therein, or stickers attached thereto. In a case where the icon area is formed of a liquid crystal display, the icon may be an image displayed in the liquid crystal display.

In the example shown in FIG. 10, a fourth timepiece hand AN is further provided in a position corresponding to the icon area AB. The processing section 110 carries out a process of determining whether it is the daytime or nighttime on the basis of the current time and placing the fourth timepiece hand AN in such a way that it points at an icon corresponding to a result of the determination. The user can thus grasp whether it is the daytime or nighttime at present with the current time displayed.

Figure 11:
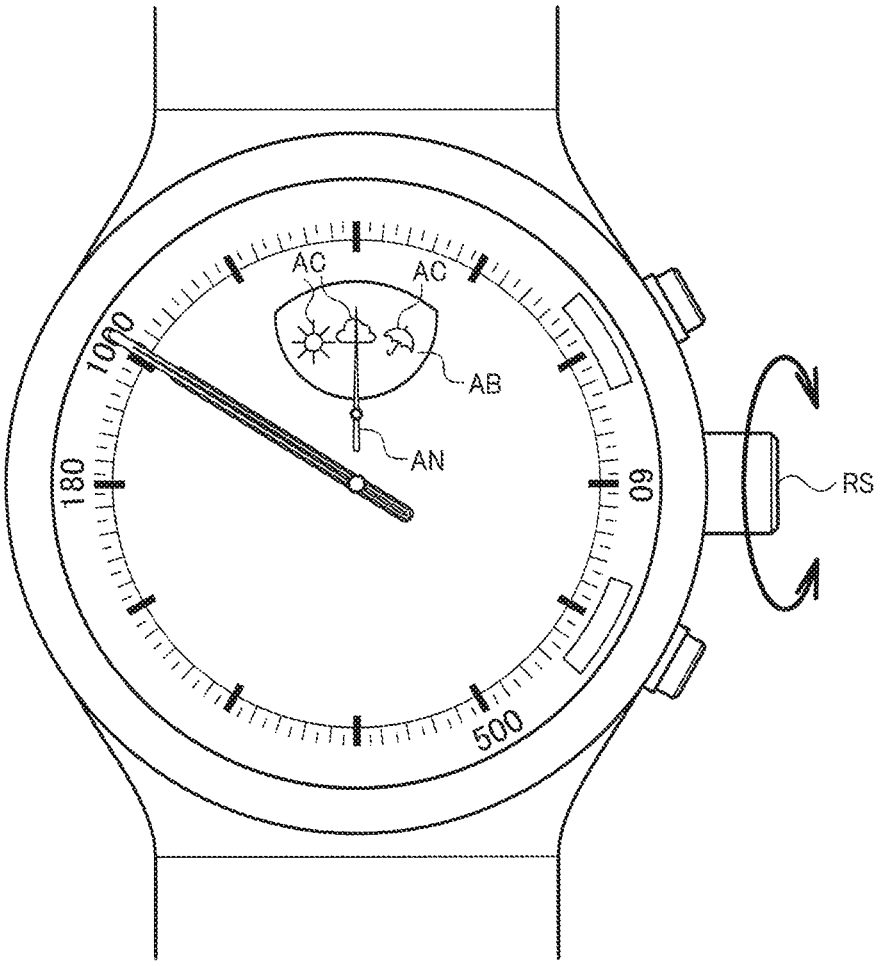
FIG. 11 describes a mode in which an icon representing atmospheric conditions is displayed in the icon area.

The content displayed in the icon area is not limited to the example shown in FIG. 10. For example, in the example shown in FIG. 11, an icon AC representing the atmospheric conditions (weather) is provided in the icon area AB. Specifically, in the example shown in FIG. 11, a fine weather icon, a cloudy weather icon, and a rainy weather icon are provided as the icon representing the atmospheric conditions (whether). The processing section 110 carries out a process of placing the fourth timepiece hand AN on the basis of atmospheric condition information acquired, for example, by the measured value acquisition section 120 in such a way that the fourth timepiece hand AN points at an icon corresponding to the current atmospheric conditions. The user can thus grasp the current atmospheric conditions with the current time displayed.

Figure 12:
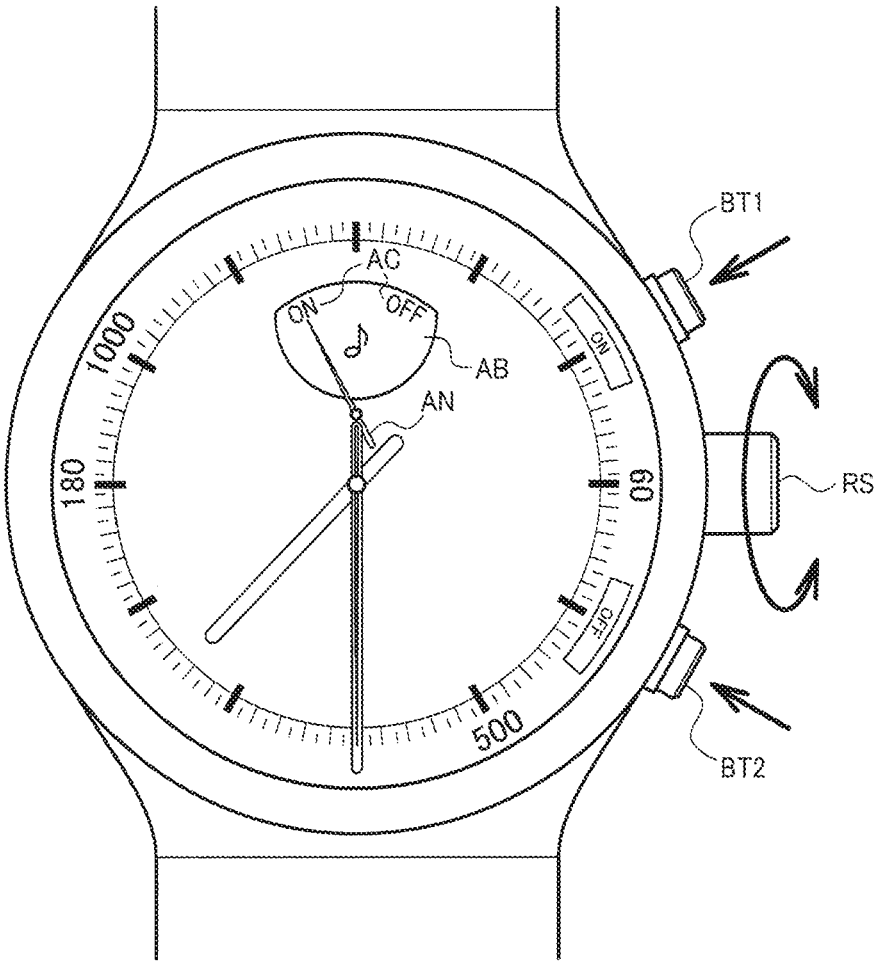
FIG. 12 describes a mode in which an icon representing the state of reproduction of music is displayed in the icon area.

Further, for example, in the example shown in FIG. 12, an icon AC representing whether music is turned on or off is provided in the icon area AB. The processing section 110 carries out a process of placing the fourth timepiece hand AN, for example, in such a way that it points at an icon corresponding to the current state of reproduction of the music. The user can thus grasp the current state of reproduction of the music.

Figure 13:
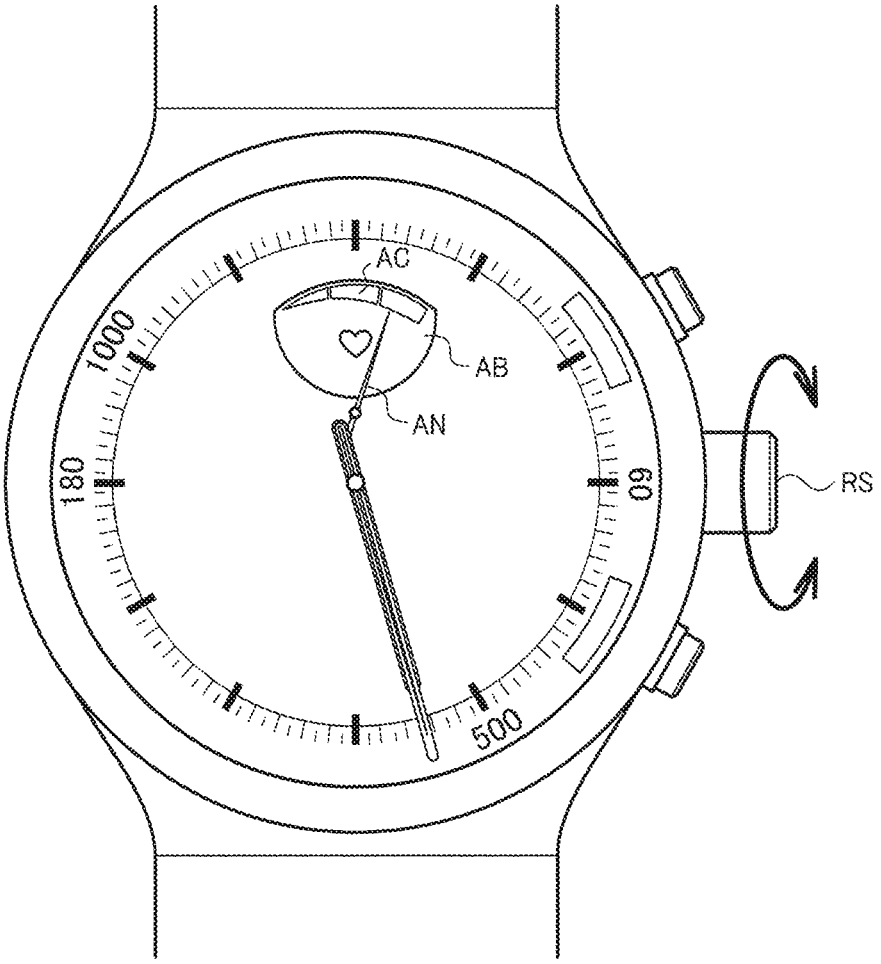
FIG. 13 describes a mode in which an icon representing the magnitude of the pulse rate is displayed in the icon area.

Another variation in which an icon AC representing the magnitude of the pulse rate is provided in the icon area AB is conceivable, as shown in the example illustrated in FIG. 13. In this case, the processing section 110 carries out a process of placing the fourth timepiece hand AN in a position corresponding to the magnitude of an acquired pulse rate.

The user can therefore, for example, check time indicated by the first timepiece hand to the third timepiece hand and check another piece of information at the same time.

Figure 14:
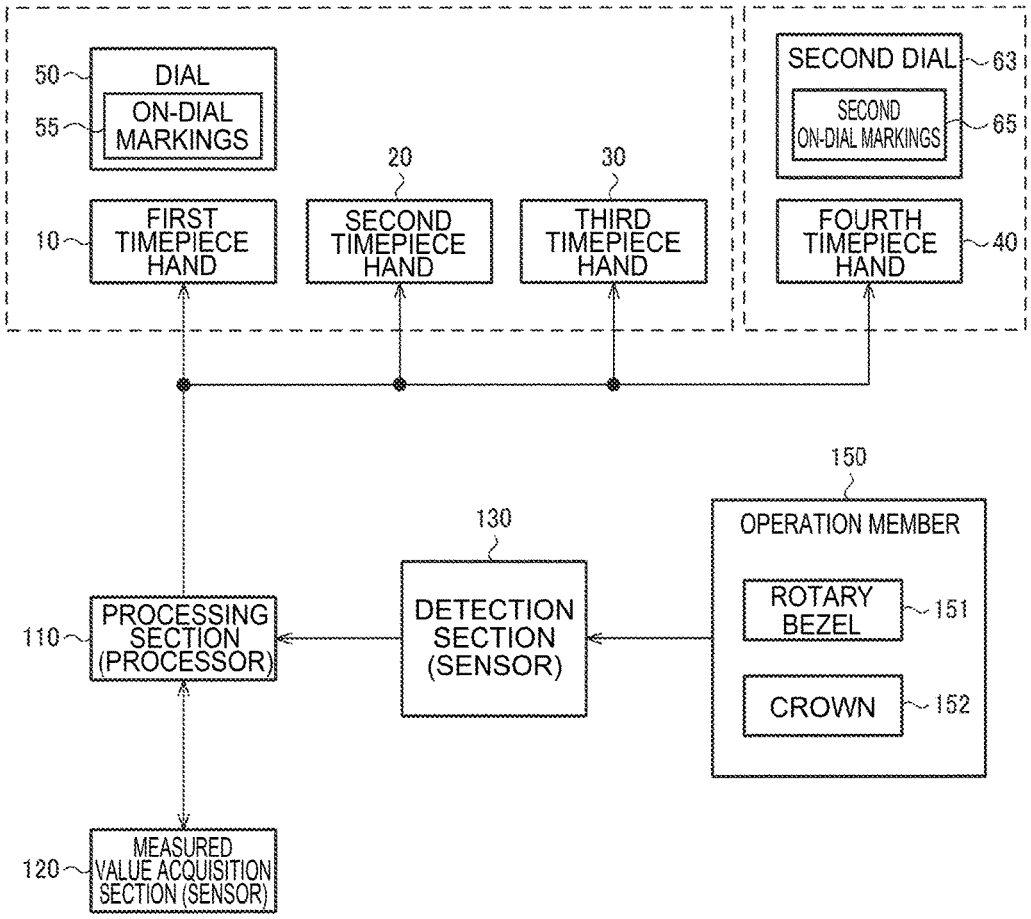
FIG. 14 describes an example of another system configuration according to a variation of the embodiment.

In another variation of the present embodiment, the wearable terminal apparatus 100 can further include a fourth timepiece hand 40 and a second dial 63, which is provided in correspondence with the fourth timepiece hand 40 and has second on-dial markings 65, in addition to the configuration shown in FIG. 1, as shown in FIG. 14.

The processing section 110 controls of the fourth timepiece hand 40 in such a way that it is placed in a position corresponding to a measured value among the second on-dial markings 65 of the second dial 63.

Figure 15:
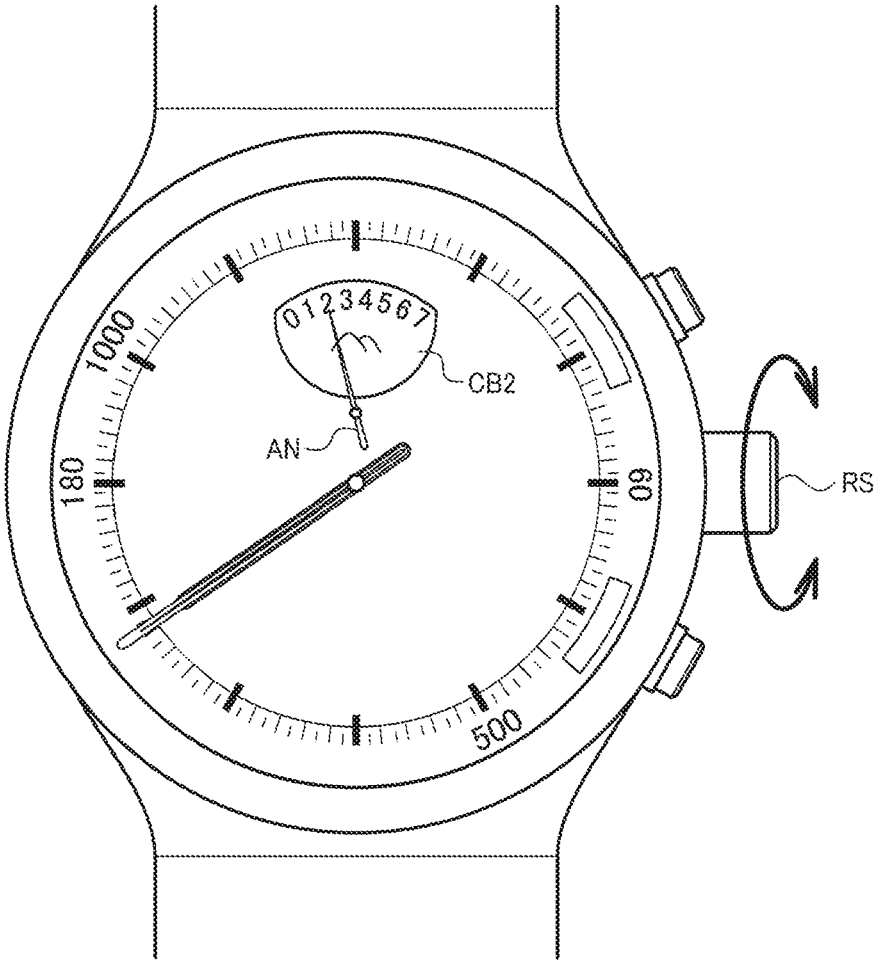
FIG. 15 describes a mode in which the altitude is displayed by using second on-dial markings.

For example, in the example shown in FIG. 15, the wearable terminal apparatus 100 includes a second dial CB2, which has second on-dial markings representing the altitude. The second on-dial markings display the current altitude in the form of 8 levels (zones). Also in this case, the processing section 110 carries out a process of placing the fourth timepiece hand 40 on the basis of acquired altitude information in such a way that the fourth timepiece hand 40 points at a level corresponding to the current altitude. The user can thus grasp that which one of the 8 levels the current altitude corresponds to with the current time displayed.

Figure 16:
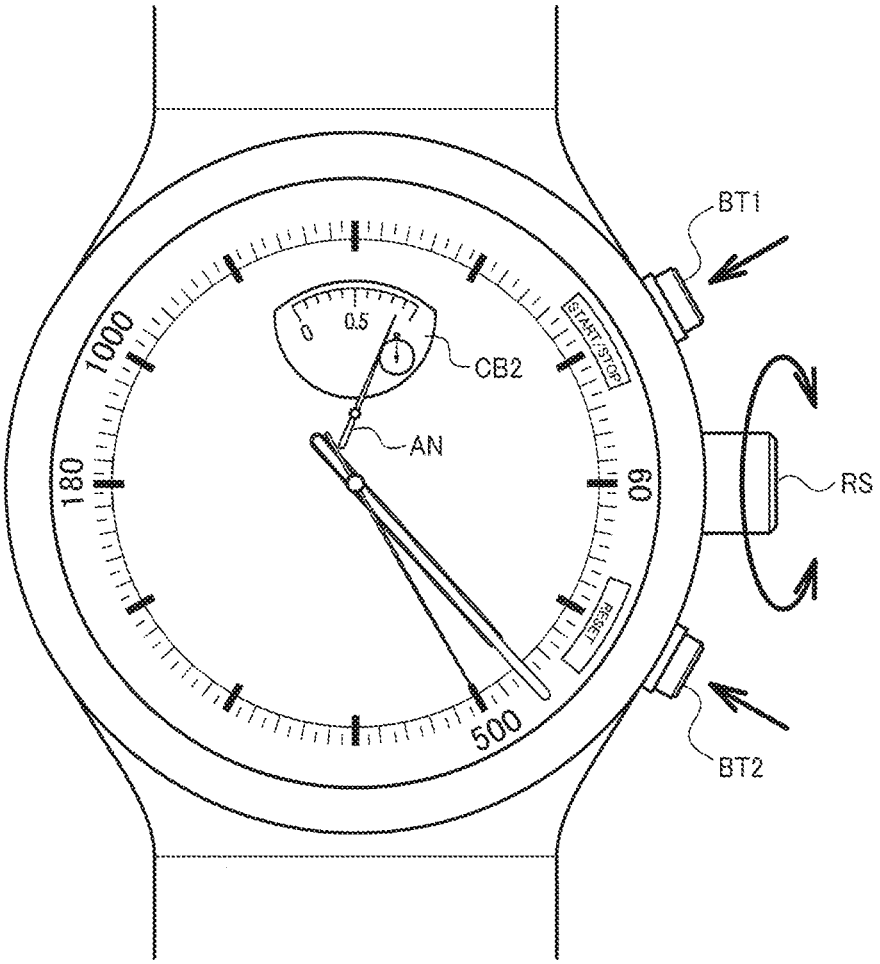
FIG. 16 describes a mode in which a measured period is displayed by using second on-dial markings.

The second dial CB2 may instead have second on-dial markings representing a measured period, as shown in FIG. 16. In this case, for example, the user rotates the crown RS to set the wearable terminal apparatus 100 in the measured period display mode described above. The user then presses down a button BT1 provided in the enclosure of the wearable terminal apparatus 100 to start measurement of a period. The processing section 110 carries out a process of placing the fourth timepiece hand AN in such a way that the fourth timepiece hand points at a measured period among the second on-dial markings. Further, when the user presses down a button BT2, the period measurement is terminated. The user can thus measure a period while checking the current time.

The user can therefore, for example, check time indicated by the first timepiece hand to the third timepiece hand and check the numeral of another measured value at the same time.

The examples illustrated with reference to FIGS. 10 to 13, 15, and 16 may be switchable from one to another, for example, by operation of the crown RS provided in the enclosure of the wearable terminal apparatus 100. That is, the initial state may, for example, be the mode shown in FIG. 10, in which the daytime or nighttime is displayed, and rotation of the crown RS in this state may cause the mode to transition to the mode shown in FIG. 11, in which the atmospheric conditions are displayed. When the crown RS is then further rotated, the mode may transition to the mode shown in FIG. 12, in which the current state of reproduction of the music is displayed. The transition pattern of the display mode using the fourth timepiece hand can be changed in a variety of manners.

Further, the present variation is not limited to the case where the first timepiece hand to the third timepiece hand keep displaying time when the processing section 110 controls the fourth timepiece hand. For example, when the processing section 110 controls the fourth timepiece hand, the display performed by the fourth timepiece hand may be combined with the display of the pulse rate, the atmospheric pressure, the altitude, or any other measured value performed by the first timepiece hand to the third timepiece hand, as in the examples shown in FIGS. 4 to 6 described above.

The present embodiment has been described above in detail, and a person skilled in the art could readily understand that many variations that do not substantially depart from the novel items and advantageous effects of the invention are conceivable. It is therefore intended that these variations all fall within the scope of the invention. For example, in the specification or the drawings, a term at least once described with a different term having an extended meaning or the same meaning can be replaced with the different term in any location in the specification or the drawings. Further, the configuration and action of the wearable terminal apparatus are not limited to those described in the present embodiment and can be changed in a variety of manners.

What is claimed is:

1. A wearable terminal apparatus comprising:

an enclosure;

a dial provided in the enclosure and having on-dial markings;

a first timepiece hand;

a second timepiece hand;

a third timepiece hand;

a processing section that controls rotation of the first timepiece hand, the second timepiece hand, and the third timepiece hand; and a measured value acquisition section that acquires a measured value, wherein the processing section controls placement of the timepiece hands among the on-dial markings in such a way that the first timepiece hand is placed in a position corresponding to a lower limit value of the measured value, the second timepiece hand is placed in a position corresponding to an upper limit value of the measured value, and the third timepiece hand is placed in a position corresponding to the measured value, the processing section is configured to switch between a first display mode in which the measured value corresponds to a first measured value that is displayed and a second display mode in which the measured value corresponds to a second measured value that is displayed, and the same on-dial markings of the dial are used in both the first display mode and the second display mode.

2. The wearable terminal apparatus according to claim 1, wherein the first timepiece hand is one of an hour hand and a minute hand, the second timepiece hand is another hand different from the one of the hour hand and the minute hand, and the third timepiece hand is a second hand.

3. The wearable terminal apparatus according to claim 2, further comprising:

a fourth timepiece hand; and a second dial provided in correspondence with the fourth timepiece hand and having second on-dial markings, wherein the processing section controls placement of the fourth timepiece hand among the second on-dial markings on the second dial in such a way that the fourth timepiece hand is placed in a position corresponding to an additional measured value among the second on-dial markings.

4. The wearable terminal apparatus according to claim 2, further comprising:

a fourth timepiece hand; and an icon area provided in correspondence with the fourth timepiece hand and provided with a plurality of icons, wherein the processing section controls placement of the fourth timepiece hand in the icon area and in a position corresponding to an icon selected from the plurality of icons.

5. The wearable terminal apparatus according to claim 1, wherein the measured value acquisition section acquires at least one of living body detection information, activity detection information, and environment detection information as the measured value.

6. The wearable terminal apparatus according to claim 1, wherein positions where the first timepiece hand and the second timepiece hand are placed among the on-dial markings in the first display mode differ from positions where the first timepiece hand and the second timepiece hand are placed among the on-dial markings in the second display mode.

7. The wearable terminal apparatus according to claim 6, wherein in the first display mode, the lower limit value corresponds to a lower limit value of a first measurement range corresponding to the first measured value and the upper limit value corresponds to an upper limit value of the first measurement range, and the processing section controls the timepiece hands in such a way that the first timepiece hand is placed in a position corresponding to the lower limit value of the first measurement range and the second timepiece hand is placed in a position corresponding to the upper limit value of the first measurement range, and in the second display mode, the lower limit value corresponds to a lower limit value of a second measurement range corresponding to the second measured value and the upper limit value corresponds to an upper limit value of the second measurement range, and the processing section controls the timepiece hands in such a way that the first timepiece hand is placed in a position corresponding to the lower limit value of the second measurement range and the second timepiece hand is placed in a position corresponding to the upper limit value of the second measurement range.

8. The wearable terminal apparatus according to claim 7, further comprising a detection section that detects operation of rotating an operation member rotatable around a predetermined axis of rotation, wherein when the detection section detects the operation of rotating the operation member, the processing section performs the switching of the first display mode and the second display mode from one to another.

9. The wearable terminal apparatus according to claim 7, wherein the first display mode and the second display mode are two display modes out of an altitude display mode, an atmospheric pressure display mode, a pulse display mode, a step count display mode, and a distance display mode.

10. The wearable terminal apparatus according to claim 6, further comprising a detection section that detects operation of rotating an operation member rotatable around a predetermined axis of rotation, wherein when the detection section detects the operation of rotating the operation member, the processing section performs the switching of the first display mode and the second display mode from one to another.

11. The wearable terminal apparatus according to claim 10, wherein the first display mode and the second display mode are two display modes out of an altitude display mode, an atmospheric pressure display mode, a pulse display mode, a step count display mode, and a distance display mode.

12. The wearable terminal apparatus according to claim 6, wherein the first display mode and the second display mode are two display modes out of an altitude display mode, an atmospheric pressure display mode, a pulse display mode, a step count display mode, and a distance display mode.

13. The wearable terminal apparatus according to claim 6, wherein the on-dial markings in a first range of the dial differ from the on-dial markings in a second range of the dial in terms of a magnitude of a numeral represented by one marking.

14. The wearable terminal apparatus according to claim 6, wherein the on-dial markings are arranged on the dial in a circular or arcuate manner.

15. The wearable terminal apparatus according to claim 6, further comprising:

a fourth timepiece hand; and a second dial provided in correspondence with the fourth timepiece hand and having second on-dial markings, wherein the processing section controls placement of the fourth timepiece hand among the second on-dial markings on the second dial in such a way that the fourth timepiece hand is placed in a position corresponding to an additional measured value among the second on-dial markings.

16. The wearable terminal apparatus according to claim 6, further comprising:

a fourth timepiece hand; and an icon area provided in correspondence with the fourth timepiece hand and provided with a plurality of icons, wherein the processing section controls placement of the fourth timepiece hand in the icon area and in a position corresponding to an icon selected from the plurality of icons.

17. The wearable terminal apparatus according to claim 1, wherein the on-dial markings in a first range of the dial differ from the on-dial markings in a second range of the dial in terms of a magnitude of a numeral represented by one marking.

18. The wearable terminal apparatus according to claim 1, wherein the on-dial markings are arranged on the dial in a circular or arcuate manner.

19. The wearable terminal apparatus according to claim 1, further comprising:

a fourth timepiece hand; and a second dial provided in correspondence with the fourth timepiece hand and having second on-dial markings, wherein the processing section controls placement of the fourth timepiece hand among the second on-dial markings on the second dial in such a way that the fourth timepiece hand is placed in a position corresponding to an additional measured value among the second on-dial markings.

20. The wearable terminal apparatus according to claim 1, further comprising:

a fourth timepiece hand; and an icon area provided in correspondence with the fourth timepiece hand and provided with a plurality of icons, wherein the processing section controls placement of the fourth timepiece hand in the icon area and in a position corresponding to an icon selected from the plurality of icons.

* * * * *